US005367956A

United States Patent [19]

Fogle, Jr.

[11] Patent Number: 5,367,956

[45] Date of Patent: Nov. 29, 1994

[54] HERMETICALLY-SEALED ELECTRICALLY-ABSORPTIVE LOW-PASS RADIO FREQUENCY FILTERS AND ELECTRO-MAGNETICALLY LOSSY CERAMIC MATERIALS FOR SAID FILTERS

[76] Inventor: Homer W. Fogle, Jr., 15 Green Valley Rd., Wallingford, Pa. 19086-6050

[21] Appl. No.: 832,473

[22] Filed: Feb. 7, 1992

[51] Int. Cl.[5] ..... F42B 3/188

[52] U.S. Cl. ..... 102/202.2; 333/81 R; 361/248

[58] Field of Search ..... 102/202.1, 202.2; 333/182, 184, 81 R, 185; 361/248, 266; 264/42

[56] References Cited

U.S. PATENT DOCUMENTS

| | | | |
|---|---|---|---|
| 2,951,999 | 9/1960 | Marchese | 333/81 R |
| 3,125,733 | 3/1964 | Holinbeck | 333/81 R |
| 3,227,083 | 1/1966 | Moses et al. | 102/202.2 |
| 3,264,989 | 8/1966 | Rucker | 102/202.2 |
| 3,380,004 | 4/1968 | Hansen | 333/184 |
| 4,146,854 | 3/1979 | Ishino et al. | 333/81 R |
| 4,795,944 | 1/1989 | Stimson | 315/71 |

FOREIGN PATENT DOCUMENTS

| | | | |
|---|---|---|---|
| 1280667 | 11/1961 | France | 333/81 R |

*Primary Examiner*—Stephen M. Johnson
*Attorney, Agent, or Firm*—John F. A. Earley; John F. A. Earley, III

[57] ABSTRACT

An electromagnetically lossy liquid- or gas-tight fusion seal for use as a low pass radio frequency signal filter constructed as a matrix of glass binder and ferromagnetic and/or ferroelectric filler. Metal cased electrical filters are made by reflowing the material to form fused glass-to-metal seals and incorporating electrical thru-conductors therein which may be formed as inductive windings.

12 Claims, 2 Drawing Sheets

HERMETICALLY-SEALED ELECTRICALLY-ABSORPTIVE LOW-PASS RADIO FREQUENCY FILTERS AND ELECTRO-MAGNETICALLY LOSSY CERAMIC MATERIALS FOR SAID FILTERS

BACKGROUND OF THE INVENTION

1. Field of the Invention

This invention relates to dissipative hermetically sealed electrical filter assemblies which incorporate electromagnetically lossy ceramic materials to provide a low-pass frequency response.

2. Description of the Prior Art

Radio frequency interference (RFI) suppression filters having a low-pass characteristic are commonly incorporated in electrical interconnection devices to insure that unwanted radio frequency signals are suppressed while allowing the passage of direct current (DC) and low frequency alternating current (AC) signals. This RFI suppression function is sometimes required to insure the unimpeded operation of RF sensitive electronic equipment in an intensive RF signal environment or, alternatively, to prevent the conductive or radiative emission of RF energy from electronic devices. The RFI suppression function is of considerable concern in the design of electroexplosive devices (EEDs) where the failure to suppress RF energy might lead directly to the unpropitious functioning of an explosive charge. Such filters must pass direct currents with negligible internal loss.

In many cases, electrical devices incorporating these RFI filters are also required to provide a gas-tight seal to protect sensitive components or materials contained within an enclosure. Heretofore, the electrical low-pass filters and the mechanical gas- or liquid-tight seals required by these devices have been separate and distinct components. Many EEDs incorporate a hermetically sealed chamber for their energetic chemical material that is vulnerable to degradation by the intrusion of water vapor. Electrical access to this chamber is obtained by a high integrity glass-to-metal seal that incorporates imbedded electrical thru-conductors, hereafter called electrodes. Similarly, many bulkhead mounted connectors also incorporating RFI suppression filters that are used in aerospace applications are constructed using glass- or ceramic-to-metal sealing techniques to achieve required gas- and liquid-tightness.

Absorptive filters are those that dissipate applied RF power within a solid medium in the form of heat which must be efficiently conducted to the environment. The loss mechanism may be electrical, magnetic or a combination thereof. These lumped- or distributed-element dielectromagnetic structures may be complemented with associated reactive structures (series inductances and shunt capacitances) to achieve desired electrical network characteristics.

Electrically dissipative ceramics formed primarily from alumina and silicon carbide are described in L. E. Gates, Jr., et al. U.S. Pat. No. 3,538,205 issued on Nov. 3, 1970 for "Method of Providing Improved Lossy Dielectric Structure For Dissipating Electrical Microwave Energy," and in L. E. Gates, Jr., et al. U.S. Pat. No. 3,671,275 issued on Jun. 20, 1970 for "Lossy Dielectric Structure For Dissipating Electrical Microwave Energy." Electrical loss tangents as high as 0.6 are reported. L. E. Gates, Jr., et al. U.S. Pat. No. 3,765,912 issued on Oct. 16, 1973 for "MgO-SiC Lossy Dielectric for High Power Electrical Microwave Energy" reports a further development based on a matrix of magnesia and silicon carbide. However, these compositions feature negligible magnetic loss, high porosity, high melting points, and poor wetting characteristics when in the liquid state. As such, they are unsuitable for forming fusion seals with metallic members.

Magnetically dissipative materials having acceptably high magnetic loss tangents and DC volume resistivities are commercially available in the form of spinel ferrites. E. C. Snelling in *Soft Ferrites, Properties and Applications* (Second edition) (Butterworths, Stronham, Mass., 1988) describes the electromagnetic properties of these materials. P. Schiffres in "A Dissipative Coaxial FRI Filter", *IEEE Transactions on Electromagnetic Compatibility* (January 1964, pp. 55–61), describes the application of these materials for constructing lossy transmission line filters and J. H. Francis, in "Ferrites as Dissipative RF Attenuators," Technical Memorandum W-11/66, U.S. Naval Weapons Laboratory, Dahlgren, Va., (1966), describes their application as EED attenuation elements.

Various glass sealing compositions have been developed for bonding ferrite shapes to one another as reported in J. F. Ruszczyk U.S. Pat. No. 3,681,044 issued on Aug. 1, 1972 for "Method of Manufacturing Ferrite Recording Heads With a Multipurpose Devitrifiable Glass," R. Huntt U.S. Pat. No. 4,048,714 issued on Sep. 20, 1977 for "Glass Bonding of Manganese-Zinc Ferrite," and Y. Mizuno et al. U.S. Pat. No. 4,855,261 issued on Aug. 8, 1989 for "Sealing Glass." These compositions do not feature the electromagnetically lossy characteristics that would render them useful as RF absorbers.

Assemblies incorporating magnetically lossy RF absorptive filter elements, typically spinel ferrites in the form of sintered beads, and physically distinct mechanical seal elements, typically fused glass-to-metal structures, are described in T. Warnhall U.S. Pat. No. 3,572,247 issued on Mar. 23, 1971 for "Protective RF Attenuator Plug for Wire-Bridge Detonators, J. A. Barret U.S. Pat. No. 4,422,381 issued on Dec. 27, 1983 for "Ignitor With Static Discharge Element and Ferrite Sleeve," and H. W. Fogle U.S. patent application Ser. No. 07-706211 executed on May 28, 1991, for "Filtered Electrical Connection Assembly Using Potted Ferrite Element." These designs require separate processing steps to form the filter and seal elements.

Assemblies incorporating electrically lossy RF absorptive filter elements, typically ferroelectric materials such as Barium Titanate ($BaTiO_3$) in the form of tubular capacitors, and physically distinct mechanical seal elements are described in W. G. Clark U.S. Pat. No. 3,840,841 issued on Oct. 8, 1974 for "Electrical Connector Having RF Filter," K. S. Boutros U.S. Pat. No. 4,187,481 issued on Feb. 5, 1980 for "EMI Filter Connector Having RF Suppression Characteristics," and S. E. Focht U.S. Pat. No. 4,734,663 issued on Mar. 29, 1988 for "Sealed Filter Members and Process For Making Same."

Certain automotive spark plugs unify the RF filter and mechanical seal functions in a glassy ceramic structure that forms a fused seal. For example, G. L. Stimson U.S. Pat. No. 4,112,330 issued on Sep. 5, 1978 for "Metallized Glass Seal Resistor Compositions and Resistor Spark Plugs," K. Nishio et al. U.S. Pat. No. 4,224,554 issued on Sep. 23, 1980 for "Spark Plug Having a Low Noise Level," M. Sakai U.S. Pat. No. 4,504,411 issued on Mar. 12, 1985 for "Resistor Composition For Resistor-Incorporated Spark Plugs," and G. L. Stimson U.S. Pat. No. 4,795,944 issued on Jan. 3, 1989 for "Metallized Glass Seal Resistor Composition," describe ceramic composition hermetic seals that also act as series connected electrically dissipative resistances, typically 5000 ohms, to attenuate RF energy generated at the spark gap so as to reduce RFI emissions from the vehicle ignition system. These designs depend entirely upon ohmic and dielectric loss mechanisms to dissipate RF energy. More significantly, they do not have metallic electrically conducting electrodes that pass through the glassy seal region with the result that DC losses are significant. These factors render this technology useless for the manufacture of electrical thru-bulkhead fittings, connectors and EEDs where DC continuity is an essential performance requirement.

Plastics with ferromagnetic or ferroelectric fillers that are intended for use as RF signal attenuating media are described in H. J. Sterzel U.S. Pat. No. 4,879,065 issued on Nov. 7, 1989 for "Processes of Making Plastics Which Absorb Electromagnetic Radiation and Contain Ferroelectric and/or Piezoelectric Substances." Such plastics allow the design of attenuating filters that have imbedded electrodes shaped in useful inductive configurations, e.g. spirals and helical windings. However, these materials do not have the mechanical durability and chemical resistance required for mechanical gas- and liquid-tight seals, particularly at extreme hot and cold temperatures.

Filters featuring spiral shaped electrodes imbedded in lossy ferromagnetic ceramics are reported in Dow et. al. U.S. Pat. No. 4,848,233 issued on Jul. 18, 1989 for "MEANS FOR PROTECTING ELECTROEXPLOSIVE DEVICES WHICH ARE SUBJECT TO A WIDE VARIETY OF RADIO FREQUENCY". These fragile high-porosity devices can not simultaneously serve as fluid sealing elements.

While filter/seal equipped thru-bulkhead fittings, connectors, EEDs and spark plugs such as those described in the prior art patents have met with considerable success, they nevertheless suffer from the disadvantage of complexity in that they require a multiplicity of constituent parts and various means for joining same together to achieve the electrical, mechanical and heat transfer functions intended. This complexity leads to significant manufacturing cost, particularly if the filter designs are not amenable to assembly by high speed machinery.

SUMMARY OF THE INVENTION

It is an object of this invention to provide a simplified and low-cost means of constructing electrical low pass RFI suppression gas-tight filters.

Another object of this invention is to provide an electro-magnetically lossy glass-like ceramic material suitable for forming low reflow temperature fusion seals incorporating imbedded thru-conductor electrodes of various useful shapes, e.g. straight pins, spiral windings with and without reversals in direction and helical windings with and without reversals in direction, that act as low-pass electrical networks. These seals feature improved manufacturability and electrothermal performance over designs now available.

These and other objects are accomplished by providing a method for constructing low-pass dissipative RFI suppression filters with intrinsic hermetic seals. Furthermore, the design for the filters provides inherently efficient power handling capacity and mechanical ruggedness. The inventive filter comprises a sealing glass suitable for manufacturing electrical ceramic-to-metal seals that are gas-tight and highly lossy with respect to the transmission of radio frequency signals. The inventive ceramic composition is a dense matrix formed from a glass binder and an electromagnetically lossy filler comprised of a spinel structured ferromagnetic material and/or perovskite structured ferroelectric material. A non-metallic heat resistant fixture 31 is provided to hold the casing 13 and electrodes 14 in a fixed position to each other.

It should of course be understood that the description and drawings herein are merely illustrative and that various modifications and changes may be made in the structures disclosed without departing from the spirit of the invention.

DESCRIPTION OF THE PREFERRED EMBODIMENTS

Figure 1:
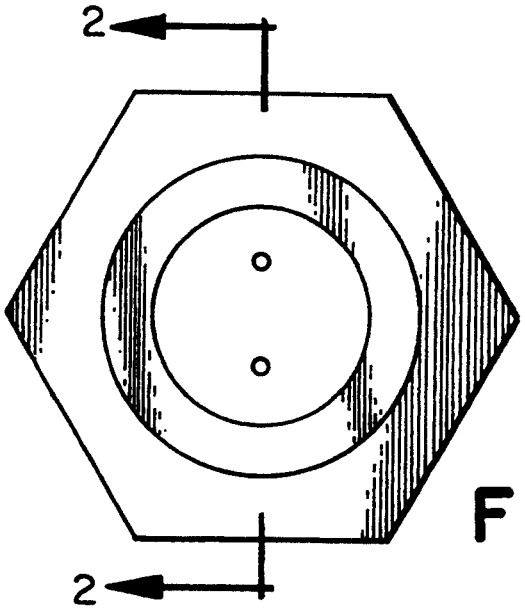
FIG. 1 is an end view of one embodiment of a filter-seal assembly of the invention with two straight thru-conductor electrodes.
Figure 2:
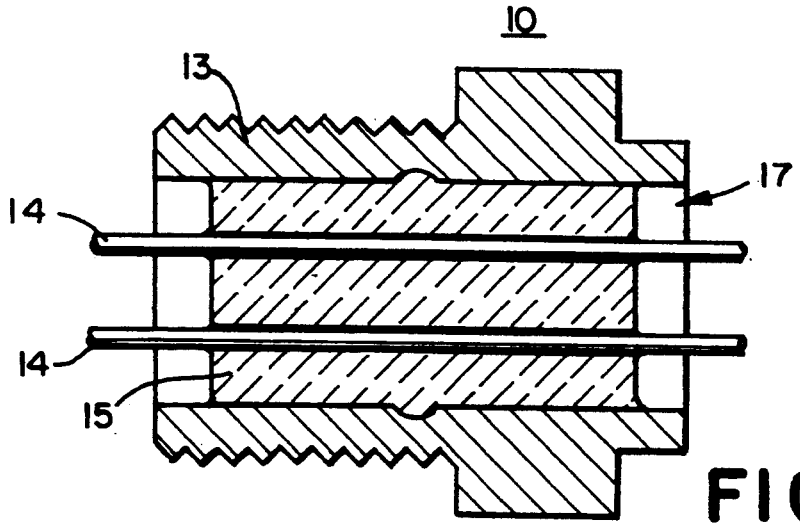
FIG. 2 is a vertical cross-sectional view taken approximately on the line 2—2 of FIG. 1, and also adds a fixture.

Referring now more particularly to the drawings and FIGS. 1 and 2 thereof, one embodiment of a filter-seal assembly 10 of the invention is disclosed. The filter-seal assembly 10 includes an electrically conductive metallic casing 13 having a passageway 17 therethrough. Two electrodes 14 extend through and beyond the passageway 17 of the metallic casing 13. A non-metallic heat resistant fixture 31 is provided to hold the casing 13 and electrodes 14 in a fixed position to each other. A solid plug of ceramic material 15 is provided, to be described and which is fused to the casing 13 and to the electrodes 14 so as to span the passageway 17, thereby forming a gas-tight electromagnetically lossy seal.

Figure 3:
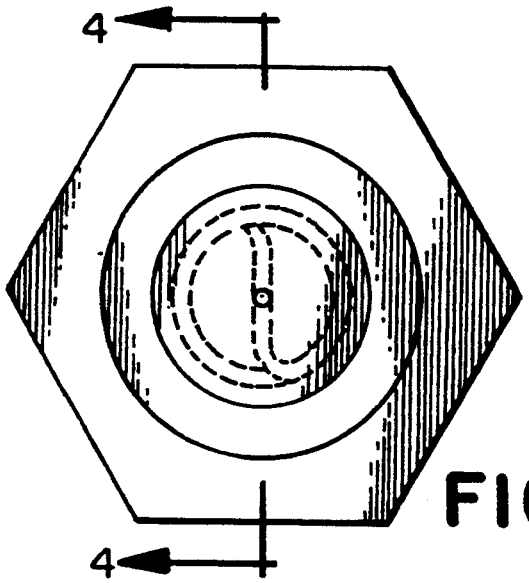
FIG. 3 is an end view of another embodiment of a filter/seal assembly of the invention with a single thru-conductor electrode formed in the shape of a helical winding.
Figure 4:
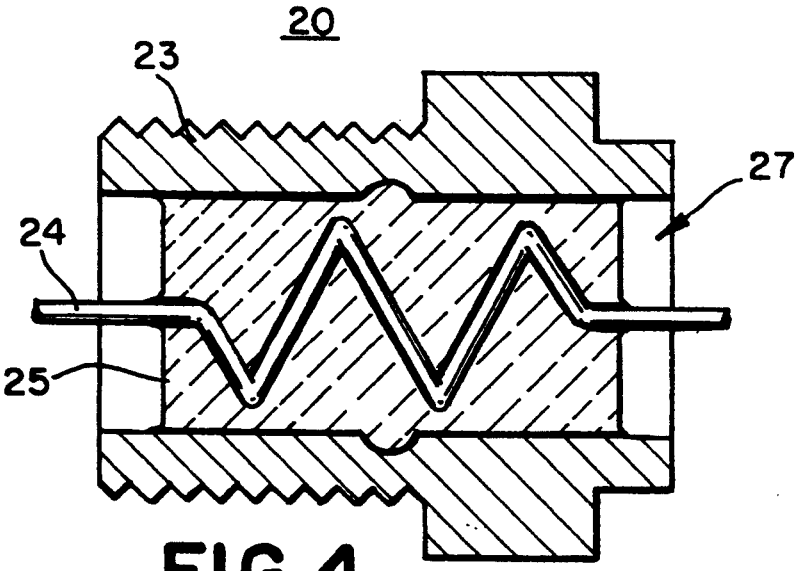
FIG. 4 is a vertical cross-sectional view taken approximately on the line 4.4 of FIG. 3.

Referring now more particularly to FIGS. 3 and 4 of the filter/seal assembly 20 of the invention, another embodiment is disclosed. The filter/seal assembly 20 includes a metallic casing 23 having a passageway 27 therethrough and electrode 24 extends through/and/beyond the casing 23 which is illustrated as being of helical shape. A solid plug 25 of ceramic material is provided, to be described and which is fused to the casing 23 and the electrode 24 so as to span the passageway 27 hereby forming a gas-tight electromagnetically lossy seal.

The ceramic plugs 15 and 25 are of an electromagnetically lossy glass-like ceramic material. This material comprises a dense matrix which includes a composition glass binder and an electromagnetically lossy filler by weight of 50–95% interspersed throughout the matrix.

The electrode may be linear or curvilinear (e.g., spiral windings with or without reversals in direction, and helical windings with or without reversals in direction).

A single electrode or a plurality of electrodes may be used in each filter/seal assembly 10, 20.

It should be noted that the plugs 15 and 25 may be pre-formed with through holes (not shown) prior to insertion in casings 10 and 20 with later placement of the conductors 14 or 24 and reflowed for sealing to be described.

Acceptable binders include, but are not limited to, Lead Borosilicate and Lead Aluminoborosilicate glasses which include oxides of Al, B, Ba, Mg, Sb, Si and Zn. Commercially available materials in the form of finely ground frits include CORNING (Corning N.Y.) high temperature ferrite sealing glasses, e.g. #1415, #8165, #8445, CORNING low temperature ferrite sealing glasses, e.g. #1416, #1417, #7567, #7570 and #8463, and FERRO CORPORATION (Cleveland, Ohio) low temperature display sealing glasses, e.g. #EG4000 and #EG4010.

Acceptable ferromagnetic fillers include, but are not limited to spinel structured ferrites of the type $(AaO)_{1-x}(BbO)_xFe_2O_3$ where Aa and Bb are divalent metal cations of Ba, Cd, Co, Cu, Fe, Mg, Mn, Ni, Sr or Zn, and x is a fractional number on the semi-open interval [0,1). Sintered Manganese-Zinc and Nickel-Zinc spinel ferrite powders such as FAIR-RITE PRODUCTS (Wallkill, N.Y.) #73 and #43, respectively, are examples.

Acceptable ferroelectric fillers include, but are not limited to, perovskite titanates of the type $(XxO)TiO_2$ and perovskite zirconates of the type $(XxO)ZrO_2$ where Xx denotes divalent metal cations of Ba, La, Sr or Pb. Barium titanate, $(BaO)TiO_2$, is a typical species. Other acceptable fillers include electrically lossy La-modified $Pb(Zr, Ti)O_3$ perovskite ceramics known as PLZTs.

The electromagnetically lossy ceramic mixture is formed by mixing the-binder and filler in a ball mill with ceramic media in a volatile organic carrier liquid with a forming agent and fatty acid dispersant. This invention includes compositions consisting of 5–50% by weight of binder and 50–95% by weight of filler. The resulting mixture is then dried.

Filter/seals may be constructed directly from this dried mixture by suitably fixturing a quantity of it with the metallic elements, i.e. the casing and electrodes. The assembly is then brought to a temperature above the glass working point, the mixture is allowed to reflow, and finally the assembly is allowed to cool so that a fusion seal results. This technique allows the use of electrodes that have been preformed into electrically useful shapes, e.g. as helical inductors.

Alternatively, the dried mixture may be reflowed at elevated temperature to form desired shapes or "pre-forms" in the configuration of vitreous solid cylindrical pellets, toroids, spheres or wafers with one or more thru-holes. These pre-forms may be used in conjunction with high-speed automated machinery to pre-assemble the end-item before it is submitted to the reflow furnace for fusion sealing. The vitreous pre-forms must be substantially free of voids to insure uniformity of the filter/seals that result from their use. They should be sized to provide a free running fit with respect to the end item casing, and the electrical conductors. Dimensional tolerances may be relatively loose as long as the mass of the preform is closely controlled.

EXAMPLE 1

A header subassembly incorporating a filter/seal for use in an electro-explosive device illustrates an implementation of the invention.

The ceramic composition is prepared by mixing the filler, a finely ground (325 mesh) commercial grade sintered Nickel-Zinc spinel ferrite powder, $(NiO)_{0.3}(ZnO)_{0.7}Fe_2O_3$, with the binder, a ground (325 mesh) Lead Aluminoborosilicate glass (10% Silica, 10% Boron Oxide, 15% Aluminum Oxide and 75% Lead Oxide, all by weight), in a polyethylene ball mill with zirconia or alumina media, polyvinyl alcohol or acetone as the organic carrier liquid, polyvinyl acetate or polyvinyl butyrol as the forming agent, and menhaden fish oil as the dispersant. The filler/binder ratio is 85%, by weight. The resulting material is dried, pressed into the shape of a toroid using a press equipped with a stainless steel die set, placed on a silica firing plate having a suitable conformal indentation and vitrified at 590° C. in an oxidizing atmosphere for 45 minutes. A vitreous toroid shaped pre-form free of organic material is thus obtained after subsequent cooling and solidification.

Characteristic properties of the fused ceramic material at 25° C. are given in Table I:

TABLE I

| | | |
|---|---|---|
| Density | 4.6 | g/cm$^3$ |
| Thermal Conductivity | 3.5 | W/C-m |
| Specific Heat | 0.8 | J/g-sec |
| Thermal Diffusivity | $9 \times 10^{-7}$ | m$^2$/sec |
| Thermal Coefficient of Expansion | 8.5 | ppm/C |
| Helium Permeability | $10^{-12}$ | darcys |
| Curie Temperature | 140 | C. |
| DC resistivity | $10^6$ | ohm-cm |
| Dielectric Strength, min. | 200 | V/mil |
| RF Properties at 10 MHz | | |
| Dielectric Constant | 10 | |
| Initial Permeability | 500 | |
| Loss Tangent | | |
| magnetic, u''/u' | 1 | |
| electric, e''/e' | 0.1 | |
| Unguided Waves Propagation Constant | | |
| attenuation constant | 5.3 | nepers/m |

The EED header is manufactured by joining (1) the cylindrical casing (Iron-Nickel alloy #46 per ASTM F30-85, average linear TCE 7.1–7.8 ppm/C over 300–350 C, 8.2–8.9 ppm/C over 30–500 C), (2) electrode (DUMET wire per ASTM F29-78, radial TCE 9.2 ppm/C) in the form of a straight round wire, and (3) pre-form together on a graphite or Boron Nitride fixture and then submitting the loose fitting assembly to a furnace for firing at 600° C. for 10 minutes in an oxidizing atmosphere. The pre-form melts, reflows within the casing and about the electrode and, with cooling, solidifies to form the fuzed filter/seal. The device requires a further annealing soak at 390° C. for 30 minutes to minimize microstress formation through the matrix. A slow cool to ambient temperature completes this portion of the process. Various finishing operations, such as deburring, grinding, polishing, cleaning and plating may be required to make the final part useable.

Table II summarizes the performance characteristics of a typical filter/seal plug constructed as described. The plug has a coaxial geometry with the dimensions specified.

TABLE II

| Dimensions |
|---|

TABLE II-continued

| | |
|---|---|
| Ceramic Plug Length | 1.0 cm |
| Casing Inside Diameter | 0.5 cm |
| Electrode Diameter | 0.1 cm |
| Termination Impedance @ 10 MHz | |
| Real {Z} | 1.2 ohm |
| Imag {Z} | 0.2 ohm |
| Insulation Resistance, min. (1) | $5 \times 10^7$ ohms |
| Dielectric Strength, min. (2) | 1000 VDC |
| Seal Integrity | |
| Helium Leak @ 1 atm. (3) | $10^{-8}$ $cm^3/s$ |
| Retention, min. | 3000 PSI |
| Feed Point Impedance | |
| Real {Z} | 84 ohm |
| Imag {Z} | 81 ohm |
| RF Attenuation @ MHz (4) | 18 dB |

Notes:
(1) Electrode-to-casing electrical resistance at 500 VDC, 25 C., per MIL-STD-1344, Method 3003.
(2) Electrode-to-casing dielectric withstanding voltage at sea level per MIL-STD-1344, Method 3003.
(3) Per ASTM F134-85.
(4) Terminated power loss.

EXAMPLE 2

A filter/seal in all respects as in Example #1, but with manganese-zinc spinel ferrite powder of the form $(MnO)_{0.5}(ZnO)_{0.5}Fe_2O_3$ filler/binder ratio of 60%, and a helical electrode formed as three complete turns of 0.05 cm diameter wire with a pitch of 0.15 cm, provides a terminated power loss of approximately 8 dB at 1 Mhz. The efficacy of the filter/seal declines at higher frequencies, but it offers superior performance over 0.1 to 1.0 MHz when compared to the filter/seal described in Example #1.

Quantitative Mechanical and Electrical Design Criteria

Filter/seals of the invention may be designed to meet a diverse range of quantifiable performance goals. By selection of the specific binder and filler, controlling the proportions and particle sizes thereof, adding property modifying agents and adapting the formulation process, the following intrinsic material variables may be adjusted to meet the particular extrinsic requirements of a given application:

(1) linear thermal coefficient of expansion (TCE);
(2) thermal conductivity and diffusivity;
(3) viscous gas flow permeability;
(4) strain point, i.e. the temperature at which the ceramic's viscosity is $10^{14.6}$ poise;
(5) the working point, i.e. the temperature at which the ceramic will readily flow and wet the metallic surfaces that it comes into contact with;
(6) Curie point;
(7) DC electrical volume resistivity (DCR);
(8) dielectric strength; and
(9) unguided wave attenuation constant, i.e. the real component of the complex electromagnetic propagation constant, $$= \text{Real}\{j\,2\pi f\sqrt{\epsilon^*\mu^*}\}\ \text{nepers/meter}$$

where f is the frequency (Hz), $\epsilon^*=\epsilon'-j\epsilon''$ is the complex electric permitivity (farads/meter), and $u^*=\mu'$— the complex magnetic permeability (henrys/meter).

1. Thermal Coefficient of Expansion (TCE)

High strength filter/seals require that the TCEs of binder and filler be closely matched to avoid the development of micro-stresses throughout the matrix that might lead to microcracking and failure of the seal. Furthermore, the TCE of the resulting ceramic composition must be properly related to that of the metals chosen for the end item's electrical conductors and casing. In general, the seal should be designed so as to insure that the ceramic is compressively loaded in the vicinity of the metallic members.

Spinel ferrites have TCEs falling within the range of 8 to 10 ppm/°C. The glass binders identified above are specifically designed to fall within this range. This means that good thermal-mechanical solutions exist for end items constructed of ASTM F30-85 Iron-Nickel sealing alloys #46, #48 and #52, which also fall within this range. Many other commonly available alloys, e.g. #426 stainless steel (TCE 9.0 ppm/C) are also compatible with the TCE range of the ceramic composition described herein.

2. Thermal Conductivity and Diffusivity

The filter/seal achieves its attenuation effect by the thermal dissipation of RF energy within the ceramic medium, but as the temperature of the filter/seal rises, the effective RF attenuation diminishes, becoming negligible at and above the Curie point. It is thus desirable that heat be efficiently shed to the environment with maximum efficiency. Since the thermal contact between the fused ceramic composition and the casing is nearly ideal, it is desirable to formulate the ceramic for maximum thermal conductivity to facilitate heat transfer from the interior of the fusion seal. The ceramic materials described have a typical thermal conductivity of 3.5 watts/meter-second.

The dynamic heat transfer properties of the material are important for applications where transient RF pulses must be absorbed. Thermal diffusivities for these materials fall within the range of $5\times10^{-4}$ to $5\times10^{-2}$ $meters^2$/second.

3. Viscous Gas Flow Permeability

High quality hermetically sealed electrical connectors typically require dry air leakage rates that do not exceed $10^{-7}$ cc/s, at 0.5 atmosphere differential pressure. More stringent requirements, e.g. that helium leakage rates do not exceed $10^{-8}$ cc/s, are not uncommon. This implies that the helium permeability for useful filter/seal materials resulting from this invention do not exceed $1\times10^{-11}$ darcys.

The high porosity of the ferromagnetic and ferromagnetic fillers described is overcome by liquefying the binder glass at elevated temperatures to wet, coat and infiltrate the filler particles which are thus pulled together by capillary forces to form a dense, strong glassy matrix. Thermodynamically, the surface tension between the binder and filler must be sufficiently low for this mechanism to work. This will be the case since both are metallic oxides.

4. Strain Point

The ceramic's strain point must be well above the end item's highest service temperature (typically 150° C.) and also above the highest temperature required by subsequent end-item assembly processes such as soldering (typically 200°–400° C.) that might affect the filter/seal. A lower limit of 300° C. for the annealing point is achievable for the binders identified.

5. Working Point

At the opposite extreme, the working point must be well below the temperature at which the filler melts, commences dissolution into the glass or irreversibly degrades as an electromagnetically lossy material. For the fillers identified, this requires that the working point not exceed 1000° C. and should preferably be below 600° C.

6. Curie Point

The ceramic's Curie point, primarily a function of the filler material selected, must exceed the filter/seal's maximum service temperature by an adequate engineering margin. RF attenuation will consistently diminish as the Curie temperature is approached and vanishes altogether at temperatures above the Curie temperature.

7. DC Resistivity (DCR)

The DCRs of unmodified Borosilicate and Aluminosilicate glasses used in typical low leakage electrical glass-to-metal seals are in excess of $10^{13}$ ohm-cm at 25° C. and decrease linearly with increasing temperature. High resistivity is obtained by minimizing alkali content and employing divalent ions such as lead and barium as modifiers. Cf. Kingery, et. al., in *Introduction to Ceramics* (John Wiley & Sons, New York 1976), pp. 883'4. In contrast, the nominal DCRs of the lossy commercial grade ferrites cited as fillers range from $10^2$ to $10^9$ ohm-cm at 25° C. Small percentages of modifiers such as cobalt, manganese and iron may be employed to increase DCRs for these materials at the expense of magnetic permeability and decreased Curie point if required. The high resistivities of the materials described are achieved primarily by controlling the DCR of the glass binder, and insuring that the more conductive filler particles are effectively coated by the insulating glass.

High quality sealed electrical interconnect devices typically require conductor-to-conductor insulation resistances that exceed $10^8$ ohms at 500 VDC, but EEDs that have low resistance pin-to-case bridgewires, typically 1 to 5 ohms, are satisfactory if the parallel pin-to-case leakage resistance through the glass seal is as low as 100 ohms. The compositions described may be adjusted to meet this range of DCR requirement.

8. Dielectric Strength

The ceramic materials described have a dielectric strength that substantially exceeds 150 volts/mil at 25° C.

9. Unguided Wave Attenuation Constant

The filter/seals described will dissipate RF power by multiple mechanisms: (1) magnetic dissipation in the ceramic due to hysteresis and eddy current loss, (2) electric absorption in the ceramic due to dielectric relaxation loss, and (3) ohmic conduction losses in the ceramic and metallic conductor members. The electromagnetic attenuation constant serves as a composite figure of merit for the material's RF dissipation performance. An extremely wide range of attenuation constants may be achieved within the described context by adjusting the formulation of the ceramic filler. Fillers based on Nickel-Zinc ferrites may provide attenuations in the order of 4, 18 and 80 nepers/meter at 0.1, 1 and 10 MHz, respectively, with appropriate formulation.

I claim:

1. A method of making a monolithic combination electrical low pass radio frequency absorbent filter and mechanical gas-tight seal apparatus comprising the steps of providing an electrically conductive metallic casing having a passageway therethrough;

providing an electromagnetically lossy glass-like ceramic material having a filler material dispersed in a binder, positioning said ceramic material within the passageway of said casing, positioning at least one electrode so as to extend through said ceramic material and through the passageway of said casing, holding said casing and said electrode in a fixed relation relative to each other by providing a non-metallic heat-resistant fixture, raising the temperature of said casing and said electrode until the binder of said ceramic material completely melts and reflows about said electrode and throughout interior walls of the casing passageway, lowering the temperature of said casing and said electrode so that said ceramic material resolidifies forming a monolithic combination electrical low-pass radio frequency absorbent filter and mechanical gas-tight seal apparatus by a gas-tight ceramic-to-metal fused seal completely spanning the passageway of the casing and supporting the electrode situated therein, and removing the apparatus from the heat-resistant fixture.

2. The method according to claim 1, said ceramic material being a mixture of an electromagnetically lossy filler material dispersed in a glass binder.

3. The method of claim 2, the binder including a Lead Borosilicate glass composed of Lead Oxide, Lead silicate, Boron Oxide, and Aluminum Oxide.

4. The method according to claim 2, the binder including a Lead Boroaluminosilicate glass composed of Silica, Aluminum Oxide, Boron Oxide, and Lead Oxide.

5. The method according to claim 2, the electromagnetically lossy filler material including a ferro-electric filler selected from the group consisting of titanate of the type $(CcO)TiO_2$, and a zirconate of the type $(CcO)ZrO_2$, where Cc is a divalent metal cation selected from the group consisting of Ba, La, Sr and Pb.

6. The method of claim 2, the electromagnetically lossy filler comprising a perovskite La-modified Lead Zirconium Titantate.

7. The method according claim 2, said ceramic material being in the form of a powder.

8. The method according to claim 2, said ceramic material being in the form of a pellet.

9. The method according to claim 1, including forming the ceramic material into a pellet having a through-hole, and positioning said electrode so as to extend through said pellet through-hole.

10. A method of making a monolithic combination electrical low pass radio frequency absorbent filter and mechanical gas-tight seal apparatus comprising the steps of providing an electrically conductive metallic casing having a passageway therethrough, providing an electromagnetically lossy glass-like ceramic material having a filler material dispersed in a binder, positioning said ceramic material within the passageway of said casing, positioning at least one electrode so as to extend through said ceramic material and through the passageway of said casing, providing a non-metallic heat-resistant fixture to hold said casing and said electrode in a fixed relation relative to each other, raising the temperature of said casing and said electrode until the binder of said ceramic material melts and reflows about said electrode and throughout interior walls of the casing passageway, lowering the temperature of said casing and said electrode so that said ceramic material resolidifies forming a monolithic combination electrical low-pass radio frequency absorbent filter and mechanical gas-tight seal apparatus by a gas-tight ceramic-to-metal fused seal completely spanning the passageway of the casing and supporting the electrode situated therein, and removing the apparatus from the heat-resistant fixture, said ceramic material being a mixture of an electromagnetically lossy filler material dispersed in a glass binder, the electromagnetically lossy filler material including a ferromagnetic filler comprising spinal ferrite having the general formula $(AaO)_{1-x}(BbO)_xFe_2O_3$, where Aa and Bb are divalent metal cations selected from the group consisting of Ba, Cd, Co, Cu, Fe, Mg, Mn, Ni, Sr and Zn, and x is a fractional number on the interval [0,1) .

11. A method of making a monolithic combination electrical low pass radio frequency absorbent filter and mechanical gas-tight seal apparatus comprising the steps of providing an electrically conductive metallic casing having a passageway therethrough, providing an electromagnetically lossy ceramic material, positioning said ceramic material within the passageway of said casing, positioning at least one electrode so as to extend through said ceramic material and through the passageway of said casing, holding said casing and said electrode in a fixed relation relative to each other by providing a non-metallic heat-resistant fixture, raising the temperature of said casing and said electrode until said ceramic material melts and reflows about said electrode and throughout interior walls of the casing passageway, and lowering the temperature of said casing and said electrode so that said ceramic material resolidifies forming a monolithic combination electrical low-pass radio frequency absorbent filter and mechanical gas-tight seal apparatus by a gas-tight ceramic-to-metal fused seal completely spanning the passageway of the casing and supporting the electrode situated therein, and removing the apparatus from the heat-resistant fixture, said ceramic material being a mixture of an electromagnetically lossy filler material dispersed in a glass binder, the ceramic material being formed into a pellet having a through-hole, said electrode being positioned so as to extend through said pellet through-hole, the binder including a Lead Borosilicate glass composed of Lead Oxide, Lead silicate, Boron Oxide, and Aluminum Oxide, and the electromagnetically lossy filler material including a ferromagnetic filler comprising spinal ferrite having the general formula $(AaO)_{1-x}(BbO)_xFe_2O_3$, where Aa and Bb are divalent metal cations selected from the group consisting of Ba, Cd, Co, Cu, Fe, Mg, Mn, Ni, Sr and Zn, and x is a fractional number on the interval [0,1).

12. A method of making a monolithic combination electrical low pass radio frequency absorbent filter and mechanical gas-tight seal apparatus comprising the steps of providing an electrically conductive metallic casing having a passageway therethrough, providing an electromagnetically lossy glass-like ceramic material having a filler material dispersed in a binder, positioning said ceramic material within the passageway of said casing, positioning at least one electrode so as to extend through said ceramic material and through the passageway of said casing, providing a non-metallic heat-resistant fixture to hold said casing and said electrode in a fixed relation relative to each other, raising the temperature of said casing and said electrode until the binder of said ceramic material melts and reflows about said electrode and throughout interior walls of the casing passageway, lowering the temperature of said casing and said electrode so that said ceramic material resolidifies forming a monolithic combination electrical low-pass radio frequency absorbent filter and mechanical gas-tight seal apparatus by a gas-tight ceramic-to-metal fused seal completely spanning the passageway of the casing and supporting the electrode situated therein, and removing the apparatus from the heat-resistant fixture, said ceramic material being a mixture of an electromagnetically lossy filler material dispersed in a glass binder, the electromagnetically lossy filler material including a ferromagnetic filler comprising spinal ferrite having the general formula $(AaO)_{1-x}(BbO)_xFe_2O_3$, where Aa and Bb are divalent metal cations selected from the group consisting of Ba, Cd, Co, Cu, Fe, Mg, Mn, Ni, Sr and Zn, and x is a fractional number on the interval [0,1).

* * * * *